US005162818A

United States Patent [19]

Karita et al.

[11] Patent Number: 5,162,818

[45] Date of Patent: Nov. 10, 1992

[54] INK JET RECORDING HEAD HAVING A WINDOW FOR OBSERVATION OF ELECTRICAL CONNECTION

[75] Inventors: Seiichiro Karita, Yokohama; Hideo Saikawa, Kawasaki; Hiroshi Sugitani, Machida; Yoshifumi Hattori, Yamato; Masami Ikeda, Tokyo; Asao Saito, Yokohama; Kazuaki Masuda, Sagamihara; Akio Saito, Hadano; Tsuyoshi Orikasa, Kasukabe, all of Japan

[73] Assignee: Canon Kabushiki Kaisha, Tokyo, Japan

[21] Appl. No.: 583,165

[22] Filed: Sep. 17, 1990

[30] Foreign Application Priority Data

Sep. 18, 1989 [JP] Japan ..... 1-241045
Aug. 3, 1990 [JP] Japan ..... 2-206591

[51] Int. Cl.[5] ..... B41J 2/05

[52] U.S. Cl. ..... 346/140 R; 346/75; 439/488

[58] Field of Search ..... 346/140 R, 1.1, 75; 400/126; 439/9-10, 488-491

[56] References Cited

U.S. PATENT DOCUMENTS 4,329,698 5/1982 Smith ..... 346/140 R
4,596,991 6/1986 Adomkaitis et al. ..... 346/76 PH
4,633,274 12/1986 Matsuda ..... 346/140 R
4,635,080 1/1987 Watanabe ..... 346/140 R
4,671,597 6/1987 Grill ..... 362/253
4,734,717 3/1988 Rayfield ..... 346/140 R
4,771,295 9/1988 Baker et al. ..... 346/1.1
4,820,193 4/1989 Noorily ..... 439/488
4,881,318 11/1989 Komuro et al. ..... 29/827
4,902,244 2/1990 Endo et al. ..... 439/489
4,963,897 10/1990 Kattner ..... 346/140 R

*Primary Examiner*—Benjamin R. Fuller
*Assistant Examiner*—Victor DeVito
*Attorney, Agent, or Firm*—Fitzpatrick, Cella, Harper & Scinto

[57] ABSTRACT

An ink jet apparatus includes an ink jet recording head having a housing, an ink container in the housing for containing ink, ejection outlets for ejecting the ink supplied from the ink container, and energy generating elements for generating energy contributable to the ejection of the ink through the ejection outlets, the housing being provided with a cavity. The ink jet recording head further comprises electric contacts for supplying the energy, the contacts being provided on a wall defining the cavity and a carriage on which the ink jet recording head is mounted, the carriage being provided with a contact member having electric contacts for electric coupling with the aforementioned contacts. The ink jet recording head is mounted on the carriage with the contact member being in the cavity. The housing is provided with a window extending from a cavity to permit observation of the contact member.

24 Claims, 8 Drawing Sheets

INK JET RECORDING HEAD HAVING A WINDOW FOR OBSERVATION OF ELECTRICAL CONNECTION

FIELD OF THE INVENTION AND RELATED ART

The present invention relates to an ink jet recording head and an ink jet recording apparatus using the same, wherein the ink jet recording head has an integral ink ejector for ejecting the recording liquid (ink) and an ink container for containing the ink.

An ink jet recording head has an integral ink ejector and ink container, wherein the ink ejector includes energy generating means for ejecting the recording liquid (ink), and the container contains the ink to be supplied thereto. FIG. 10 shows an example of such an ink jet recording head which has an ink container 1. It contains a porous material 2 impregnated with the ink. The ink is supplied mainly by capillary action of the ink passage extending from an unshown supply source to the ink ejecting portion. From the main assembly of the printer, printing signals are supplied to the recording head from electric contacts 6 on a printed circuit board 6B through the electric contact 6A. Then, pulse voltages are applied to the heaters (energy generating elements) disposed adjacent ink ejecting portions, and in response thereto, the recording liquid is ejected. The recording liquid consumed by the recording is supplied from the ink container by the capillary action in the ink passages adjacent to the ejecting portion. When the ink container 1 is closed, the consumption of the recording liquid produces a vacuum in the ink container. Sooner or later, the vacuum becomes too high to impede the ink ejection. To avoid this, the ink container is provided with an air vent for communication between the inside of the ink container and the ambience, the air vent being indicated by a reference 5A.

The electric contact 6 on the printed circuit board 6B are covered by an ink container housing, as shown in FIG. 10. In this example, the top part of the electric contacts is covered by the ink container housing, and therefore, the operativity has not been good when the ink jet recording head is mounted on the main assembly of the printer, because the mounting portion can not be seen. In addition, since the top portion of the ink ejecting part is covered, the permeability is not good with the result that the heat is accumulated with long term use even to such an extent that the temperature rise of the recording head impedes the ink ejection.

SUMMARY OF THE INVENTION

According to the present invention, an window is formed in the ink container housing at a position above the electric contacts and above the ink ejecting portion, and therefore, the electric contact can be easily confirmed when the ink jet recording head is mounted on the printer, so that the operativity is improved.

According to another aspect of the present invention, there is provided a slit type window, and therefore, the permeability at the ink ejecting portion is improved, and the temperature rise of the ink ejecting portion can be suppressed.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

FIGS. 2, 3, 4, 5 and 6 illustrate an ink jet unit IJU, an ink jet head IJH, an ink container IT, an ink jet cartridge IJC, a head carriage HC and a main assembly IJRA of an ink jet recording apparatus, according to an embodiment of the present invention, and relations among them. The structures of the respective elements will be described in the following.

Figure 2:
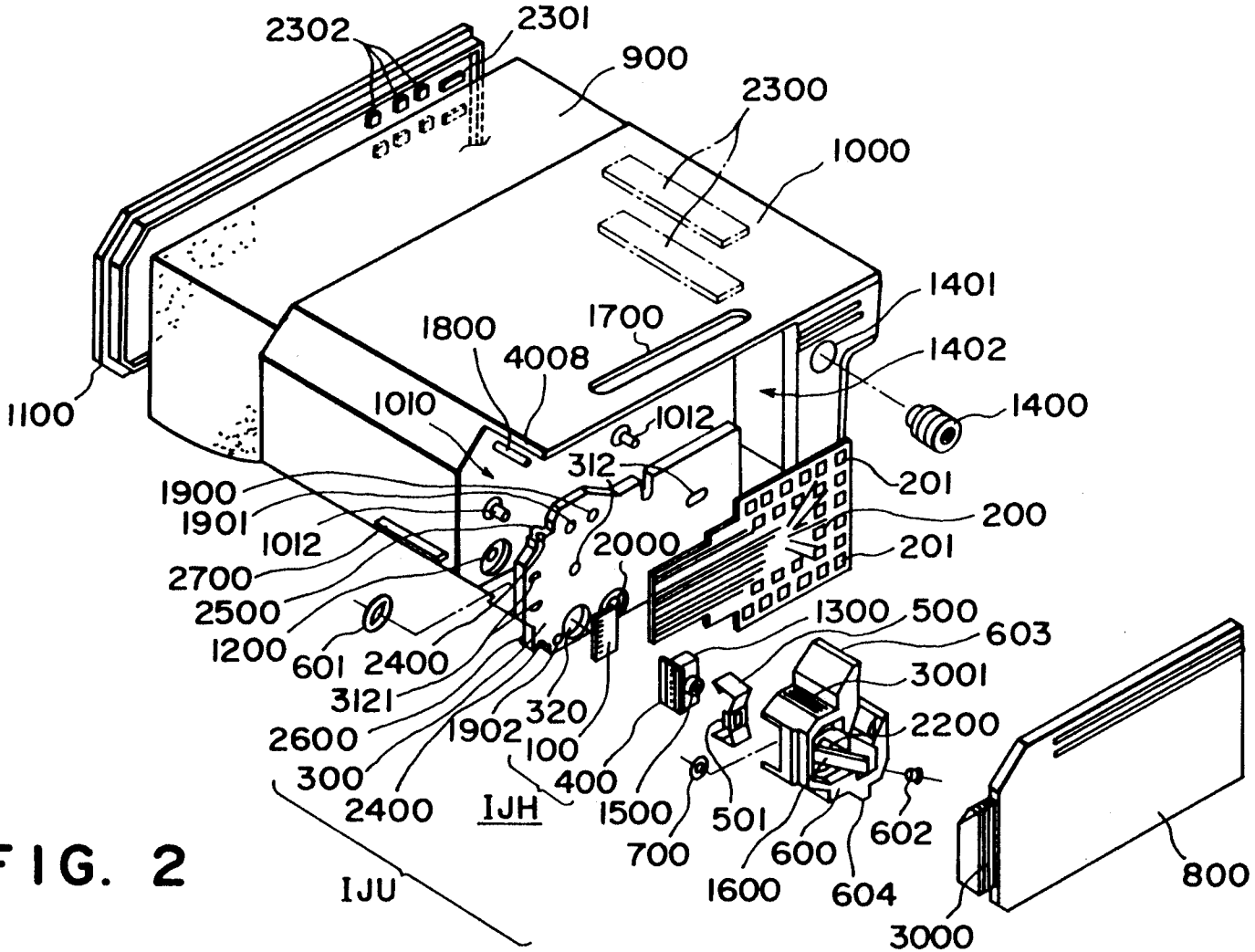
FIG. 2 is an exploded perspective view of an ink jet cartridge.
Figure 3:
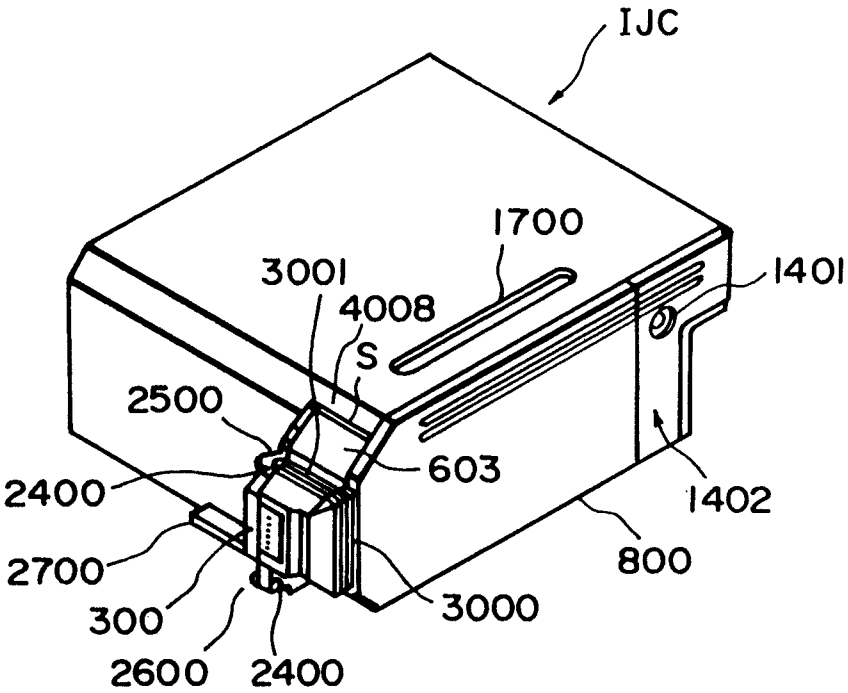
FIG. 3 is a perspective view illustrating the assembling of the cartridge of FIG. 2.

As will be understood from the perspective view of FIG. 3, the ink jet cartridge IJC in this embodiment has a relatively large ink accommodation space, and an end portion of the ink jet unit IJU is slightly projected from the front side surface of the ink container IT. The ink jet cartridge IJC is mountable at correct position on the carriage HC (FIG. 5) of the ink jet recording apparatus main assembly IJRA by proper positioning means and with electric contacts, which will be described in detail hereinafter. It is, in this embodiment, a disposable type head detachably mountable on the carriage AC. The structures disclosed in FIGS. 2–6 contain various novel features, which will first be described generally.

(i) Ink Jet Unit IJU

The ink jet unit IJU is of a bubble jet recording type using electrothermal transducers which generate thermal energy, in response to electric signals, to produce film boiling of the ink.

Referring to FIG. 2, the unit comprises a heater board 100 having electrothermal transducers (ejection heaters) arranged in a line on an Si substrate and electric lead lines made of aluminum or the like to supply electric power thereto. The electrothermal transducer and the electric leads are formed by a film forming process. A wiring board 200 is associated with the heater board 100 and includes wiring corresponding to the wiring of the heater board 100 (connected by the wire bonding technique, for example) and pads 201 disposed at an end of the wiring to receive electric signals from the main assembly of the recording apparatus.

A top plate 1300 is provided with grooves which define partition walls for separating adjacent ink passages and a common liquid chamber for accommodating the ink to be supplied to the respective ink passages. The top plate 1300 is formed integrally with an ink jet opening 1500 for receiving the ink supplied from the ink container IT and directing the ink to the common chamber, and also with an orifice plate 400 having the plurality of ejection outlets corresponding to the ink passages. The material of the integral mold is preferably polysulfone, but may be another molding resin material.

A supporting member 300 is made of metal, for example, and functions to support a backside of the wiring board 200 in a plane, and constitutes a bottom plate of the ink jet unit IJU. A confining spring 500 is in the form of an "M" having a central portion urging the common chamber with a light pressure, and a clamp 501 urges concentratedly with a line pressure a part of the liquid passage, preferably the part in the neighborhood of the ejection outlets. The confining spring 500 has legs for clamping the heater board 100 and the top plate 1300 by penetrating through the openings 3121 of the supporting plate 300 and engaging the back surface of the supporting plate 300. Thus, the heater board 100 and the top plate 1300 are clamped by the concentrated urging force by the legs and the clamp 501 of the spring 500. The supporting plate 300 has positioning openings 312, 1900 and 2000 engageable with two positioning projections 1012 and positioning and fuse-fixing projections 1800 and 1801 of the ink container IT. It further includes projections 2500 and 2600 at its backside for positioning relative to the carriage HC of the main assembly IJRA.

In addition, the supporting member 300 has a hole 320 through which an ink supply pipe 2200, which will be described hereinafter, is penetrated for supplying ink from the ink container. The wiring board 200 is mounted on the supporting member 300 by a bonding agent or the like. The supporting member 300 is provided with recesses 2400 and 2400 adjacent the positioning projections 2500 and 2600.

Figure 5:
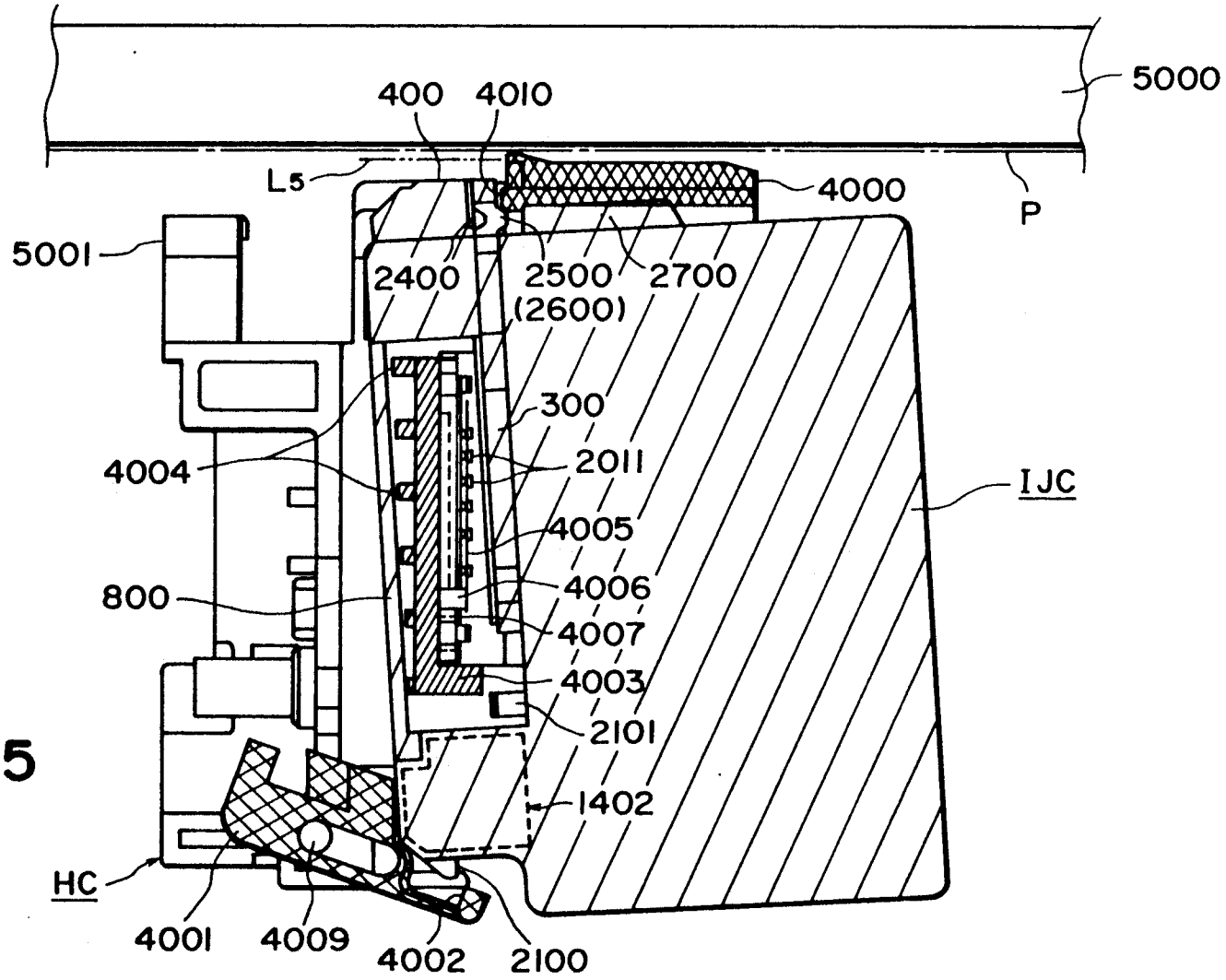
FIG. 5 illustrates mounting of the cartridge.

As shown in FIG. 3, the assembled ink jet cartridge IJC has a head projected portion having three sides provided with plural parallel grooves 3000 and 3001. The recesses 2400 and 2400 are located at extensions of the parallel grooves at the top and bottom sides to prevent the ink or foreign matter moving along the groove from reaching the projections 2500 and 2600. The covering member 800 having the parallel grooves 3000, as shown in FIG. 5, constitutes an outer casing of the ink jet cartridge IJC and cooperates with the ink container to define a space for accommodating the ink jet unit IJU. The ink supply member 600 having the parallel groove 3001 has an ink conduit pipe 1600 communicating with the abovedescribed ink supply pipe 2200 and cantilevered at the supply pipe 2200 side. In order to assure the capillary action at the fixed side of the ink conduit pipe 1600 and the ink supply pipe 2200, a sealing pin 602 is inserted.

A gasket 601 seals the connecting portion between the ink container IT and the supply pipe 2200. A filter 700 is disposed at the container side end of the supply pipe. The ink supply member 600 is molded, and therefore, it is produced at low cost with high positional accuracy. In addition, the cantilevered structure of the conduit 1600 assures the press-contact between the conduit 1600 and the ink inlet 1500 even if the ink supply member 600 is mass-produced.

In this embodiment, the complete communicating state can be assuredly obtained simply by flowing sealing bonding agent from the ink supply member side under the press-contact state. The ink supply member 600 may be fixed to the supporting member 300 by inserting and penetrating backside pins (not shown) of the ink supply member 600 through the openings 1901 and 1902 of the supporting member 300 and by heat-fusing the portion where the pins are projected through the backside of the supporting member 300. The slight projected portions thus heat-fused are accommodated in recesses (not shown) in the ink jet unit (IJU) mounting side surface of the ink container IT, and therefore, the unit IJU can be correctly positioned.

(ii) Ink Container IT

The ink container comprises a main body 1000, an ink absorbing material and a cover member 1100. The ink absorbing material 900 is inserted into the main body 1000 from the side opposite from the unit (IJU) mounting side, and thereafter, the cover member 1100 seals the main body.

The ink absorbing material 900 is thus disposed in the main body 1000. The ink supply port 1200 functions to supply the ink to the ink jet unit IJU comprising the above-described parts 100 - 600, and also functions as an ink injection inlet to permit initial ink supply to the absorbing material 900 before the unit IJU is mounted to the portion 1010 of the main body.

In this embodiment, the ink may be supplied through an air vent port and this supply opening. In order to provide a good supply of ink, ribs 2300 is formed on the inside surface of the main body 1000, and ribs 2301 and 2302 are formed on the inside of the cover member 1100, which are effective to provide within the ink container an ink existing region extending continuously from the air vent port side to that corner portion of the main body which is most remote from the ink supply opening 1200. Therefore, in order to uniformly distribute the ink, it is preferable that the ink is supplied through the supply opening 1200. This ink supply method is practically effective. The number of the ribs 2300 in this embodiment is four, and the ribs 2300 extend parallel to a movement direction of the carriage adjacent the rear side of the main body of the ink container, by which the absorbing material 900 is prevented from closely contacted to the inner surface of the rear side of the main body. The ribs 2301 and 2302 are formed on the inside surface of the cover member 1100 at positions which are substantially extensions of the ribs 2300, however, as contrasted to the large rib 2300, the size of the ribs 2301 and 2302 are small as if it is divided ribs, so that the air existing space is larger with the ribs 2301 and 2302 than with the rib 2300. The ribs 2302 and 2301 are distributed on the entire area of the cover member 1100, and the area thereof is not more than one half of the total area. Because of the provisions of the ribs, the ink in the corner region of the ink absorbing material which is most remote from the supply opening 1200 can be stably and assuredly supplied to the inlet opening by capillary action. The cartridge is provided with an air vent port for communication between the inside of the cartridge with the outside air. Inside the vent port 1400, there is a water repellent material 1400 to prevent the inside ink from leaking outside through the vent port 1400.

The ink accommodating space in the ink container IT is substantially rectangular parallelepiped, and the long side faces are in the direction of carriage movement, and therefore, the above-described rib arrangements are particularly effective. When the long side extends along the movement direction of the carriage, or when the ink containing space is in the form of a cube, the ribs are preferably formed on the entire surface of the inside of the cover member 1100 to stabilize the ink supply from the ink absorbing material 900. The cube configuration is preferable from the standpoint of accommodating as much ink as possible in limited space. However, from the standpoint of using the ink with a minimum available part in the ink container, it is best to provide ribs formed on the two surfaces constituting a corner.

In this embodiment, the inside ribs 2301 and 2302 of the ink container IT are substantially uniformly distributed in the direction of the thickness of the ink absorbing material having the rectangular parallelepiped configuration. Such a structure is significant, since the air pressure distribution in the ink container IT is made uniform when the ink in the absorbing material is consumed so that the quantity of the remaining unavailable ink is substantially zero. It is preferable that the ribs are disposed on the surface or surfaces outside a circular arc having the center at the projected position on the ink supply opening 1200 on the top surface of the rectangular ink absorbing material and having a radius which is equal to the long side of the rectangular shape, since then the ambient air pressure is quickly established for the ink absorbing material present outside the circular arc. The position of the air vent of the ink container IT is not limited to the position of this embodiment if it is good for introducing the ambient air into the position where the ribs are disposed.

In this embodiment, the backside of the ink jet cartridge IJC is flat, and therefore, the space required when mounted in the apparatus is minimized, while maintaining the maximum ink accommodating capacity. Therefore, the size of the apparatus can be reduced, and simultaneously, the frequency of the cartridge exchange is minimized. Utilizing the rear space of the space used for unifying the ink jet unit IJU, a projection for the air vent port 1401 is provided. The inside of the projection is substantially vacant, and the vacant space 1402 functions to supply the air into the ink container IT uniformly in the direction of the thickness of the absorbing material. Because of these features described above, the cartridge as a whole performs better than the conventional cartridge. The air supply space 1402 is much larger than that in the conventional cartridge. In addition, the air vent port 1401 is at an upper position, and therefore, if the ink departs from the absorbing material for some reason or another, the air supply space 1402 can tentatively retain the ink to permit such ink to be absorbed back into the absorbing material. Therefore, the wasteful consumption of the ink can be saved.

Figure 4:
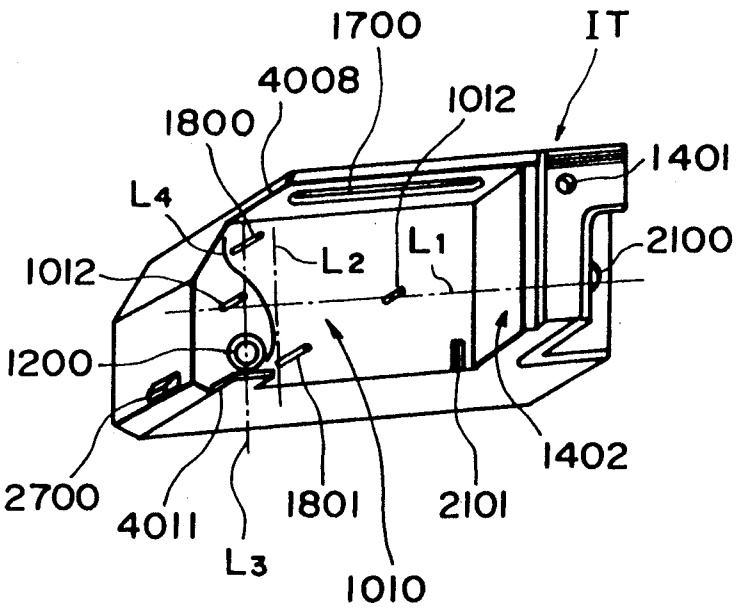
FIG. 4 is a perspective view illustrating the mounting portion of an ink jet unit.

Referring to FIG. 4, there is shown a structure of a surface of the ink container IT to which the unit IJU is mounted. Two positioning projections 1012 are on a line L1 which is a line passing through the substantial center of the array of the ejection outlets in the orifice plate 400 and parallel with the bottom surface of the ink container IT or parallel to the ink container supporting reference surface of the carriage. The height of the projections 1012 is slightly smaller than the thickness of the supporting member 300, and the projections 1012 function to correctly position the supporting member 300. On an extension (right side) in this FIG., there is a pawl 2100 with which a right angle engaging surface 4002 of a carriage positioning hook 4001 is engageable. Therefore, the force for the positioning of the ink jet unit relative to the carriage acts in a plane parallel to a reference plane including the line L1. These relationships are significant, since the accuracy of the ink container positioning becomes equivalent to the positioning accuracy of the ejection outlet of the recording head, which will be described hereinafter in conjunction with FIG. 5.

Projections 1800 and 1801 corresponding to the fixing holes 1900 and 2000 for fixing the supporting member 300 to the side of the ink container IT, are longer than the projections 1012, so that they penetrate through the supporting member 300, and the projected portions are fused to fix the supporting member 300 to the side surface. When a line L3 passing through the projection 1800 and perpendicular to the line L1, and a line L2 passing through the projection 1801 and perpendicular to the line L1, are drawn, the center of the supply opening 1200 is substantially on the line L3, the connection between the supply opening 1200 and a supply type 2200 is stabilized, and therefore, even if the cartridge falls, or even if a shock is imparted to the cartridge, the force applied to the connecting portion can be minimized. In addition, since the lines L2 and L3 are not overlapped, and since the projections 1800 and 1801 are disposed adjacent to that projection 1012 which is nearer to the ink ejection outlets of the ink jet head, the positioning of the ink jet unit relative to the ink container is further improved. In this FIG., a curve L4 indicates the position of the outer wall of the ink supply member 600 when it is mounted. Since the projections 1800 and 1801 are along the curve L4, the projections are effective to provide sufficient mechanical strength and positional accuracy against the weight of the end structure of the head IJH.

An end projection 2700 of the ink container IT is engageable with a hole formed in the front plate 4000 of the carriage to prevent the ink cartridge from being displaced extremely out of the position. A stopper 2101 is engageable with an unshown rod of the carriage HC, and when the cartridge IJC is correctly mounted with rotation, which will be described hereinafter, the stopper 2101 take a position below the rod, so that even if an upward force tending to disengage the cartridge from the correct position is unnecessarily applied, the correct mounted state is maintained. The ink container IT is covered with a cover 800 after the unit IJU is mounted thereto. Then, the unit IJU is enclosed therearound except for the bottom thereof. However, the bottom opening thereof permits the cartridge IJC to be mounted on the carriage HC, and is close to the carriage HC, and therefore, the ink jet unit is substantially enclosed at the six sides. Therefore, the heat generation from the ink jet head IJH which is in the enclosed space is effective to maintain the temperature of the enclosed space.

However, if the cartridge IJC is continuously operated for a long period of time, the temperature slightly increases Against the temperature increase, the top surface of the cartridge IJC is provided with a slit 1700 having a width smaller than the enclosed space, by which the spontaneous heat radiation is enhanced to prevent the temperature rise, while the uniform temperature distribution of the entire unit IJU is not influenced by the ambient conditions.

After the ink jet cartridge IJC is assembled, the ink is supplied from the inside of the cartridge to the chamber in the ink supply member 600 through a supply opening 1200, the whole 320 of the supporting member 300 and an inlet formed in the backside of the ink supply member 600. From the chamber of the ink supply member 600, the ink is supplied to the common chamber through the outlet, supply pipe and an ink inlet 1500 formed in the top plate 1300. The connecting portion for the ink communication is sealed by silicone rubber or butyl rubber or the like to assure the hermetical seal.

In this embodiment, the top plate 1300 is made of resin material having resistivity to the ink, such as polysulfone, polyether sulfone, polyphenylene oxide, polypropylene. It is integrally molded in a mold together with an orifice plate portion 400.

As described in the foregoing, the integral part comprises the ink supply member 600, the top plate 1300, the orifice plate 400 and parts integral therewith, and the ink container body 1000. Therefore, the accuracy in the assembling is improved, and is convenient in the mass-production. The number of parts is smaller than in the conventional device, so that good performance can be assured.

In this embodiment, as shown in FIGS. 2 - 4, the configuration after assembly is such that the top portion 603 of the ink supply member 600 cooperates with an end of the top thereof having the slits 1700, so as to form a slit S, as shown in FIG. 3. The bottom portion 604 cooperates with fed side end 4011 of a thin plate to which the bottom cover 800 of the ink container IT is bonded, so as to form a slit (not shown) similar to the slit S. The slits between the ink container IT and the ink supply member 600 are effective to enhance the heat radiation, and is also effective to prevent an expected pressure to the ink container IT from influencing directly the supply member or to the ink jet unit IJT.

The above-described various structures are individually effective to provide the respective advantages, and also they are most effective when they are combined with each other.

(iii) Mounting of the Ink Jet Cartridge IJC to the Carriage HC

In FIG. 5, a platen roller 5000 guides the recording medium P from the bottom to the top. The carriage HC is movable along the platen roller 5000. The carriage HC comprises a front plate 4000, a supporting plate 4003 for electric connection, and a positioning hook 4001. The front plate 4000 has a thickness of 2 mm, and is disposed closer to the platen. The front plate 4000 is disposed close to the front side of the ink jet cartridge IJC, when the cartridge IJC is mounted to the carriage. The supporting plate 4003 supports a flexible sheet 4005 having pads 2011 corresponding to the pads 201 of the wiring board 200 of the ink jet cartridge IJC and a rubber pad sheet 4007 for producing elastic force for urging the backside of the flexible sheet 4005 to the pads 2001. The positioning hook 4001 functions to fix the ink jet cartridge IJC to the recording position. The front plate 4000 is provided with two positioning projection surfaces 4010 corresponding to the positioning projections 2500 and 2600 of the supporting member 300 of the cartridge described hereinbefore. After the cartridge is mounted, the front plate receives the force in the direction perpendicular to the projection surfaces 4010. Therefore, plural reinforcing ribs (not shown) are extended in the direction of the force at the platen roller side of the front plate. The ribs project toward the platen roller slightly (approximately 0.1 mm) from the front side surface position L5 when the cartridge IJC is mounted, and therefore, they function as head protecting projections. The supporting plate 4003 is provided with plural reinforcing ribs 4004 extending in a direction perpendicular to the above-described front plate ribs. The reinforcing ribs 4004 have heights which decrease from the plate roller side to the hook 4001 side. By this, the cartridge is inclined as shown in FIG. 5, when it is mounted.

The supporting plate 4003 is provided with two additional positioning surfaces 4006 at the lower left portion, that is, at the position closer to the hook. The positioning surfaces 4006 correspond to projection surfaces 4010 by the additional positioning surfaces 4006, the cartridge receives the force in the direction opposite from the force received by the cartridge by the above-described positioning projection surfaces 4010, so that the electric contacts are stabilized. Between the upper and lower projection surfaces 4010, there is disposed a pad contact zone, so that the amount of deformation of the projections of the rubber sheet 4007 corresponding to the pad 2011 is determined. When the cartridge IJC is fixed at the recording position, the positioning surfaces are brought into contact with the surface of the supporting member 300. In this embodiment, the pads 201 of the supporting member 300 are distributed so that they are symmetrical with respect to the above-described line L1, and therefore, the amount of deformation of the respective projections of the rubber sheet 4007 are made uniform to stabilize the contact pressure of the pads 2011 and 201. In this embodiment, the pads 201 are arranged in two columns and upper and bottom two rows.

The hook 4001 is provided with an elongated hole engageable with a fixed pin 4009. Using the movable range provided by the elongated hole, the hook 4001 rotates in the counterclockwise direction, and thereafter, it moves leftwardly along the platen roller 5000, by which the ink jet cartridge IJC is positioned to the carriage HC. Such a movable mechanism of the hook 4001 may be accomplished by another structure, but it is preferable to use a lever or the like. During the rotation of the hook 4001, the cartridge IJC moves from the position shown in FIG. 5 to the position toward the platen side, and the positioning projections 2500 and 2600 come to the position where they are engageable to the positioning surfaces 4010. Then, the hook 4001 is moved leftwardly, so that the hook surface 4002 is contacted to the pawl 2100 of the cartridge IJC, and the ink cartridge IJC rotates about the contact between the positioning surface 2500 and the positioning projection 4010 in a horizontal plane, so that the pads 201 and 2011 are contacted to each other. When the hook 4001 is locked, that is retained at the fixing or locking position, by which the complete contacts are simultaneously established between the pads 201 and 2011, between the positioning portions 2500 and 4010, between the standing surface 4002 and the standing surface of the pawl and between the supporting member 300 and the positioning surface 4006, and therefore, the cartridge IJC is completely mounted on the carriage.

(iv) General Arrangement of the Apparatus

Figure 6:
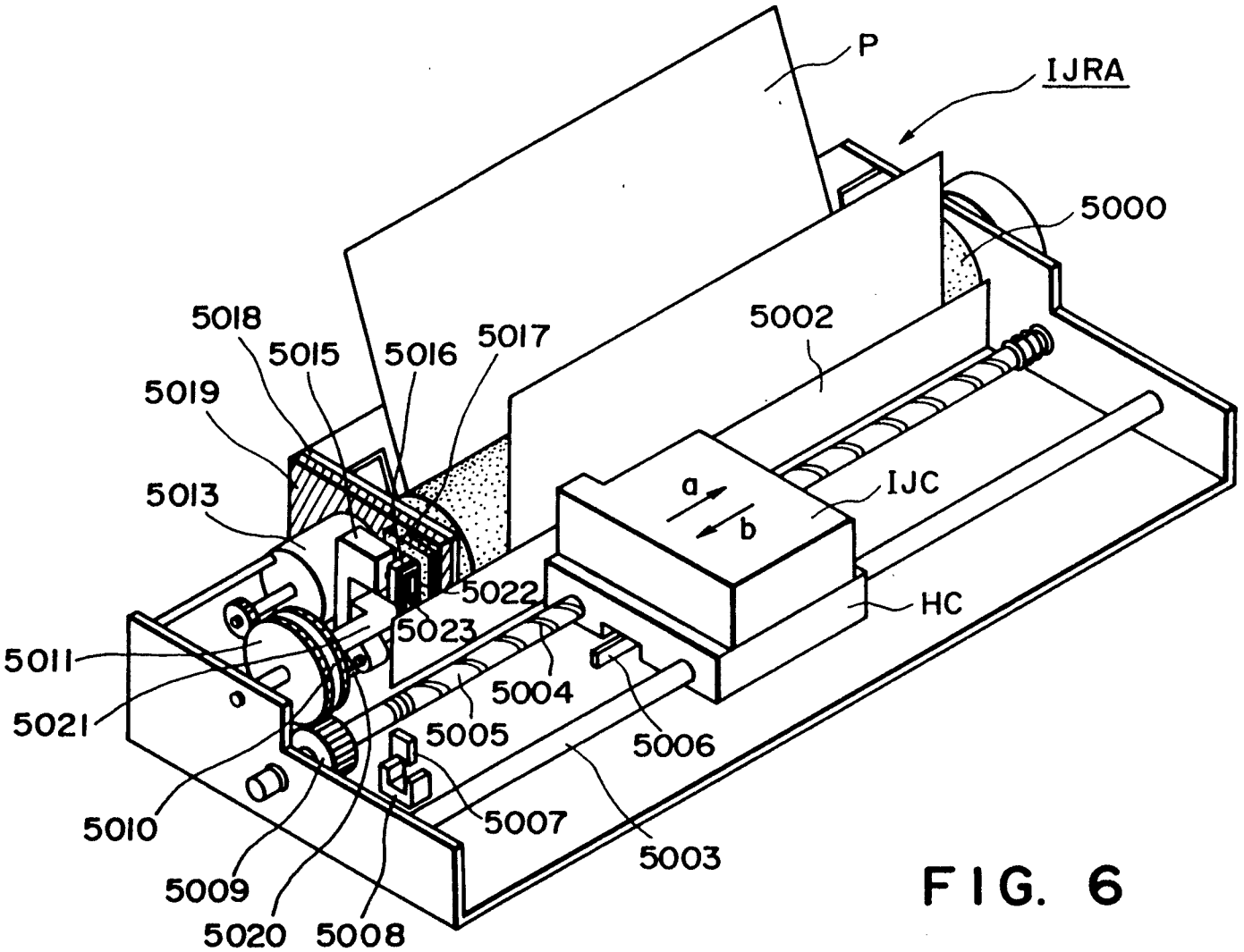
FIG. 6 shows an outer appearance of the apparatus according to the present invention.

FIG. 6 is a perspective view of an ink jet recording apparatus IJRA in which the present invention is used. A lead screw 5005 rotates by way of drive transmission gears 5011 and 5009 by the forward and backward rotation of a driving motor 5013. The lead screw 5005 has a helical groove 5004 with which a pin (not shown) of the carriage HC is engaged, by which the carriage HC is reciprocable in directions a and b. A sheet confining plate 5002 confines the sheet on the platen over the carriage movement range. Home position detecting means 5007 and 5008 are in the form of a photocoupler to detect presence of a lever 5006 of the carriage, in response to which the rotational direction of the motor 5013 is switched. A supporting member 5016 supports the front side surface of the recording head to a capping member 5022 for capping the recording head. Sucking means 5015 functions to suck ink the recording head through the opening 5023 of the cap so as to recover the recording head.

A cleaning blade 5017 is moved toward the front and rear by a moving member 5019. They are supported on the supporting frame 5018 of the main assembly of the apparatus. The blade may be in another form, more particularly, a known cleaning blade. A lever 5021 is effective to start the sucking recovery operation and is moved with the movement of a cam 5020 engaging the carriage, and the driving force from the driving motor is controlled by known transmitting means such as a clutch or the like.

The capping, cleaning and sucking operations can be performed when the carriage is moved to the home position by the lead screw 5005, in this embodiment. However, the present invention is usable in another type of system wherein such operations are effected at different timings. The individual structures are advantageous, and in addition, the combination thereof is further preferable.

Figure 1:
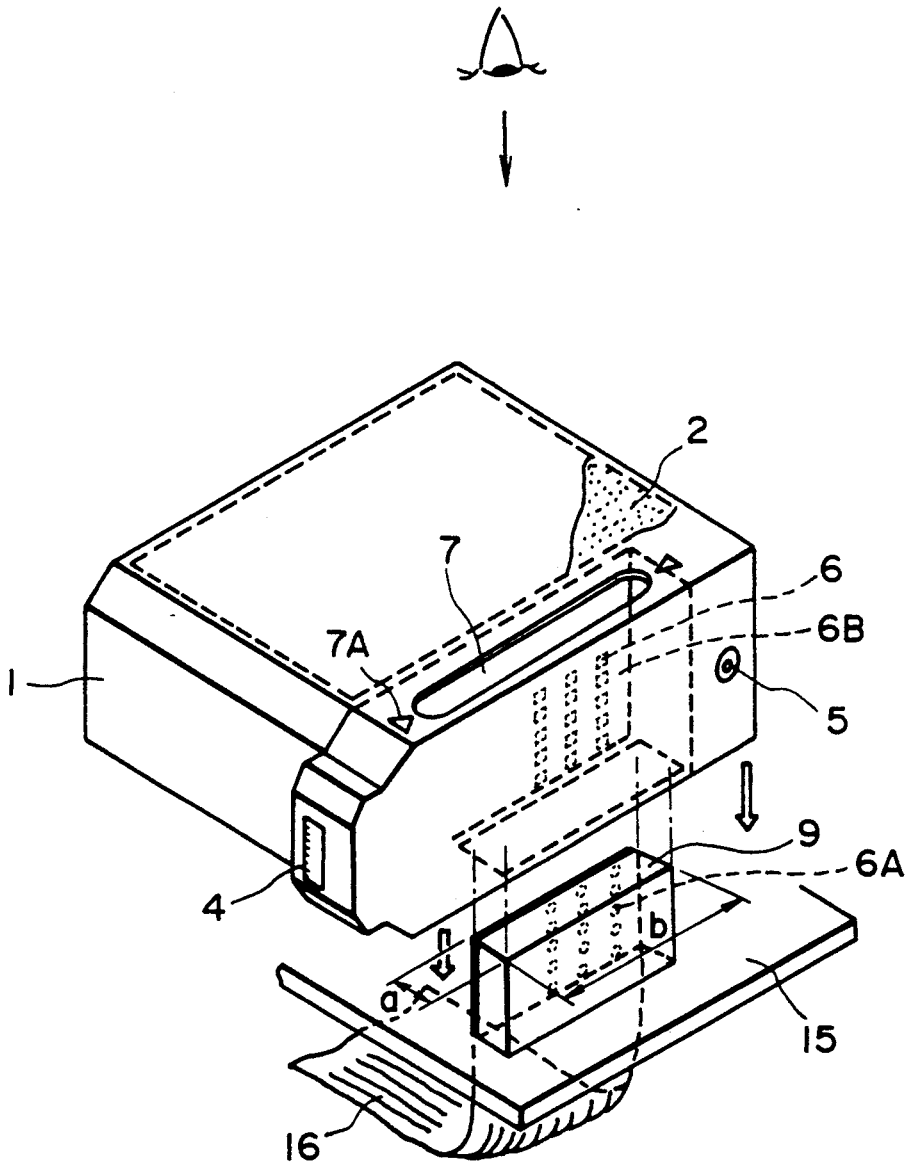
FIG. 1 is a perspective view of an ink jet head according to an embodiment of the present invention.

Referring to FIG. 1, a first embodiment of the present invention will be described. In this FIG., reference numeral 1 designates an ink container; 2 designates a porous material impregnated with the ink in the ink container 1; 4 designates an ink ejector integrally formed with the ink container 1 and having energy generating means for generating energy contributable to ejection of the ink; 5 designates a cap for capping an air vent for communication between the inside of the ink container 1 and the ambience; 6 designates electric contacts for receiving printing signals from the main assembly of the printer; 7 designates a window for permitting mounting of the ink jet recording head to the main assembly of the printer. When the electric signals are supplied from the main assembly of the printer through the electric contacts 6, the recording liquid (ink) is ejected through the ejector 4 in accordance with the signals, so that the recording is effected on the recording sheet or paper.

The ink is supplied to the ink ejector 4 mainly by the capillary action of the ink passage adjacent to the ejection portion, from the porous material 3 in the ink container. In order to prevent production of too high vacuum in the ink container, the outside vent air can flow into the container through the air port of the cap 5, corresponding to the amount of recording liquid consumed.

On a carriage 15 of the printer, there is provided an electric contact portion 9 having electric contact 6a contactable with the electric contacts 6 of the recording head. The contacts 6a are connected with a flexible cable. The recording head is mounted so that the projected contact portion 9 is inserted into a space of the recording head. At this time, the ink jet recording head can be mounted on the carriage while the contact portion 9 is being observed through the window 7.

In this embodiment, a mark 7A in a triangular form is provided on the housing adjacent opposite longitudinal ends of the window 7 of the ink jet recording head, the window 7 being in the form of a slit. When the color of the housing of the ink jet recording head is black, the color of the mark 7A is a preferably relatively light color such as yellow so that the mark 7A is conspicuous, and the color of at least the top of the contact portion 9 is preferably a relatively light color such as yellow. By doing so, the operation of inserting the contact portion 9 into the space of the ink jet recording head to establish the electric contacts between the contacts 6 and the contacts 6A, can be performed more quickly. In this case, in place of using the light color at least at the top of the contact portion 9, a separate member can be mounted on at least the top of the contact portion 9, the separate member being of the relatively light color.

Figure 7:
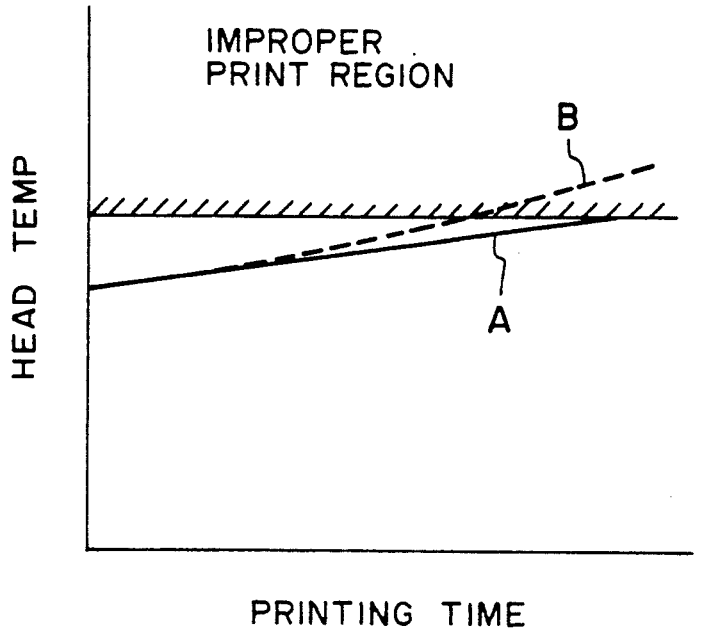
FIG. 7 is a graph of a head temperature vs. the printing period.
Figure 10:
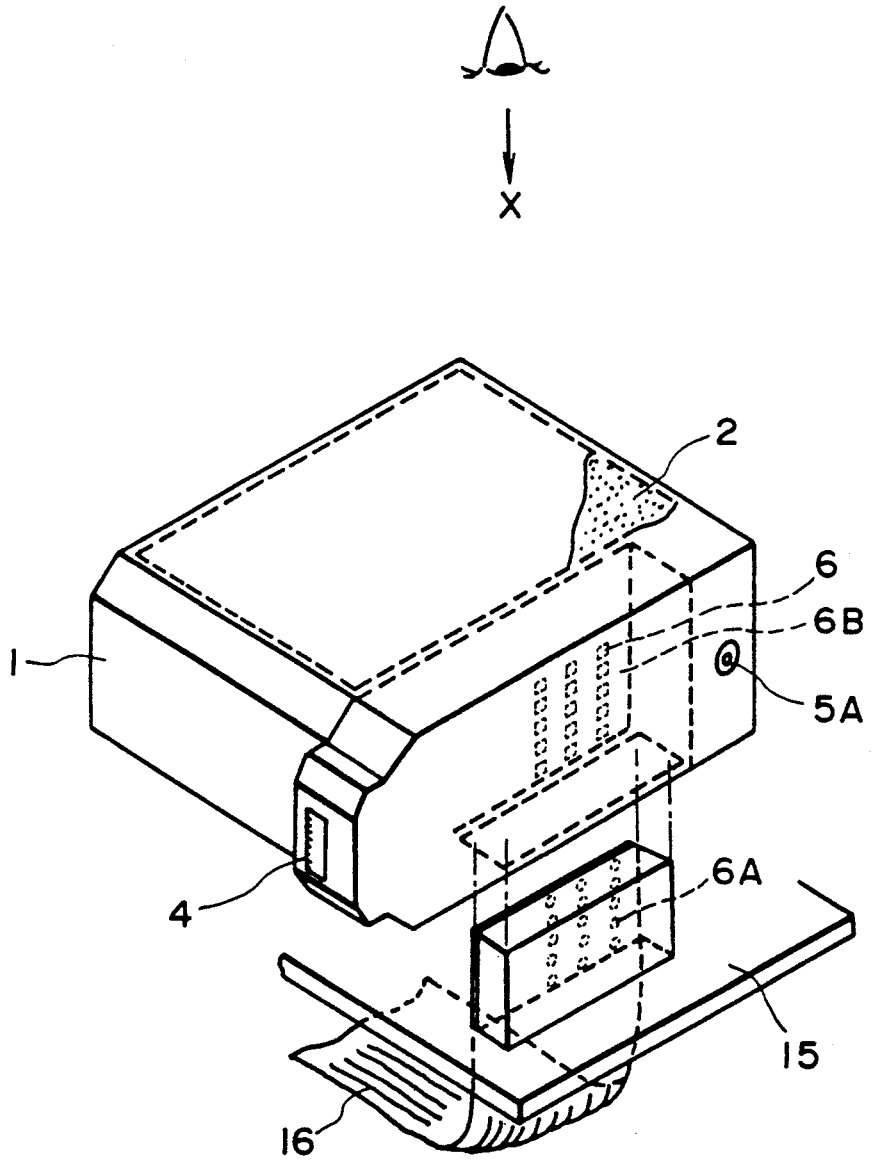
FIG. 10 is a perspective view of a conventional device.

FIG. 7 shows the temperature rise of the ink ejector of the recording head when the printing operation is continued at high duty. In this FIG., A represents the temperature change of the ink ejector of the ink jet head cartridge when it is provided with the slit like window; B represents the temperature change which can occur in the ink ejector of an ink jet head cartridge as shown in FIG. 10.

As will be understood from the FIG., the temperature rise of the ink jet recording head during continued printing, can be suppressed by the provision of the window 7.

When the head temperature increases, the volume of the recording liquid droplets ejected by the ink jet head increases, and the response frequency decreases. When the temperature of the head increases to a certain level, the recording head can not properly respond to the printing frequency with the result of improper ejection and reduction of ejection amount, which leads to deterioration of the printed image quality.

According to the embodiments, the provision of the window is effective to suppress the temperature rise of the head, and therefore, high quality printing can be maintained for a long period of time even during continued high duty printing.

The size of the window is preferably larger than a x b (FIG. 1) which is the dimensions of the contact portion 9 of the main assembly of the printer, since then, the operativity is good when the ink jet recording head is mounted on the printer. However, even if the size is smaller than the dimensions due to the limitation from the structure of the ink container, it is preferable if the contact portion can be observed.

Figure 8:
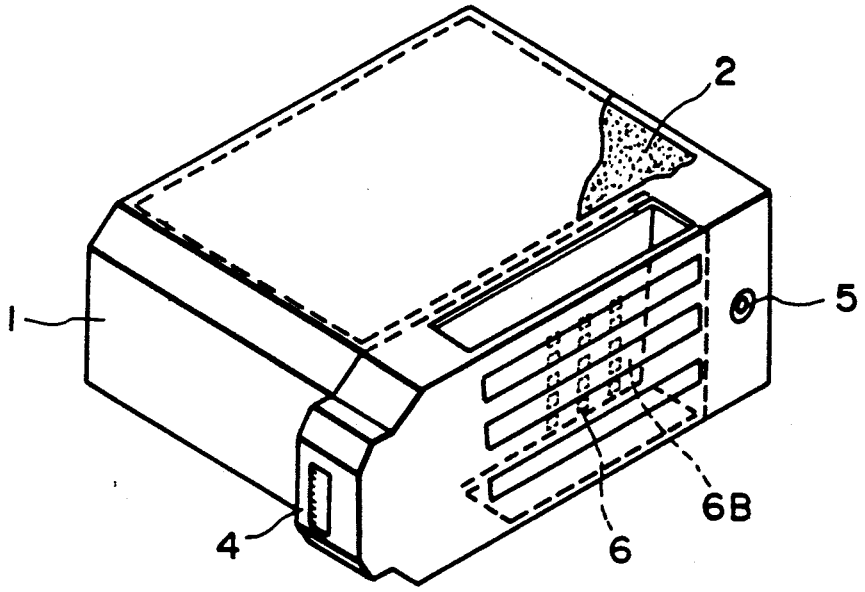
FIGS. 8 and 9 are perspective views of the devices according to other embodiment of the present invention.
Figure 9:
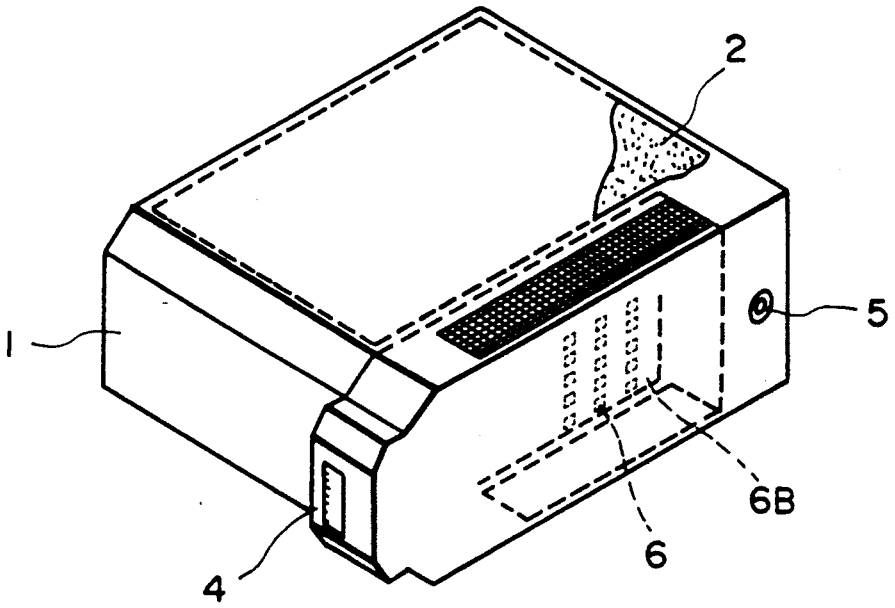

FIGS. 8 and 9 are perspective views illustrating other embodiments. In FIG. 8, a slit or slits are provided at a side of the recording head in addition to the top portion of the electric contact portion in the first embodiment.

In FIG. 9, the window of the first embodiment is covered with a screen made of resin, for example. Although it is possible to observe the electric contacts, it is difficult for an operator's finger to contact the electric contacts. In addition, the contacts can be protected from dust, and therefore, the electric contact can be protected more assuredly. In addition, since the screen is utilized, the permeability is substantially the same as in the first embodiment.

As described in the foregoing, according to the present invention, there is provided a window adjacent to the ink ejector and above the electric contacts, and therefore, the ink jet recording head mounting operativity is improved, and the permeability of ambient air is improved to suppress the temperature rise of the recording head.

Particularly, when the ejection energy generating means includes an electrothermal transducer, the heat emission effect is particularly significant.

It is particularly preferable that the window has a length larger than the length of the electric contact portion having plural electric contacts, in the form of a slit. from the standpoint of the operativity and the heat emission effect. If the slit like window extends to the neighborhood of the ink ejecting portion including the energy generating means, the heat emission effect is better. Further, the provisions of the window and the side opening at the positions corresponding to each other, is preferable for thermal balance.

In addition, the size of the window is such as to prevent operator's finger from entering the window and/or the side opening, since then, the electric contacts are not directly accessed by the fingers or the like. The electrostatic charge which can be generated by direct contact to the electric contacts by some member can adversely affect the energy generating means. Such a problem can be avoided.

The present invention is particularly suitably usable in a bubble jet recording head and recording apparatus developed by Canon Kabushiki Kaisha, Japan. This is because, the high density of the picture element, and the high resolution of the image are possible.

The typical structure and the preferred operational principle are disclosed in U.S. Pat. Nos. 4,723,129 and 4,740,796. The principle is applicable to a so-called on-demand type recording system; and a continuous type recording system particularly however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a nucleation boiling point, by which the thermal energy is provide by the electrothermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the abovementioned patents. In addition, the present invention is applicable to the structure disclosed in Japanese Laid-Open Patent Application Publication No. 123670/1984 wherein a common slit is used as the ejection outlet for plural electrothermal transducers, and to the structure disclosed in Japanese Laid-Open Patent Application No. 138461/1984 wherein an opening for absorbing a pressure wave of the thermal energy is formed corresponding to the ejecting portion. This is because the present invention is effective to perform the recording operation with certainty and at high efficiency irrespective of the type of recording head.

The present invention is effectively applicable to a so-called full-line type recording head having a length corresponding to the maximum recording width. Such a recording head may comprise a single recording head or plural recording heads combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or sucking means, preliminary heating means by the ejection electrothermal transducer or by a combination of the ejection electrothermal transducer and additional heating element and means for preliminary ejection not for the recording operation, which can stabilize the recording operation.

As regards the kind of the recording head mountable, it may be a single head corresponding to a single color ink, or may be plural heads corresponding to a plurality of ink materials having different recording colors or densities. The present invention is effectively applicable to an apparatus having at least one of a monochromatic mode mainly with black, a multi-color mode with different color ink materials, and a full-color mode by the mixture of the colors which may be an integrally formed recording unit or a combination of plural recording heads.

Furthermore, in the foregoing embodiment, the ink has been liquid. It may be, however, an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in the usual recording apparatus of this type, the ink is such that it is liquid within the temperature range when the recording signal is applied. In addition, the temperature rise due to the thermal energy is positively prevented by utilizing the heat for the state change of the ink from the solid state to the liquid state. If the ink material is solidified when it is unused, the evaporation of the ink can be prevented. In either of the cases, by the application of the recording signal for producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is positioned facing the electrothermal transducers. The most effective system for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. An ink jet apparatus comprising:

an ink jet recording head having a housing, an ink container in said housing for containing ink, ejection outlets for ejecting the ink supplied from said ink container, energy generating means for generating energy for ejection of the ink through said ejection outlets, said housing being provided with a cavity having an opening, said ink jet recording head further comprising a first set of electric contacts for supplying the energy to said energy generating means, said first set of electric contacts being provided on a wall defining said cavity, the wall not facing the opening;

a carriage on which said ink jet recording head is mounted, said carriage being provided with a contact member having a second set of electric contacts for electric coupling with said first set of electric contacts, said ink jet recording head being mounted on said carriage with the contact member being inserted in said cavity;

wherein said housing is provided with a window extending from the cavity to permit observation of contact between said first and second sets of electric contacts.

2. An apparatus according to claim 1, wherein said energy generating means includes electrothermal transducer means for generating thermal energy.

3. An apparatus according to claim 1, wherein said window is in a form of a slit having a length larger than a range in which said first and second sets of electric contacts are arranged.

4. An apparatus according to claim 3, wherein said window extends to the vicinity of an ink ejecting portion of said ink jet recording head having said energy generating means.

5. An apparatus according to claim 1, wherein said window and said cavity are aligned with each other.

6. An apparatus according to claim 1, wherein a plurality of windows are provided in different walls defining said cavity.

7. An apparatus according to claim 1, wherein said window is covered with a screen.

8. An apparatus according to claim 1, wherein said window is in a form of a slit, and marks are provided adjacent longitudinally opposite ends of said window, and wherein said marks and at least a top surface of the contact member are of a same color.

9. An apparatus according to claim 8, when each of said marks is triangular.

10. An apparatus according to claim 8, wherein the color of said marks and at least the top surface of the contact member is relatively light.

11. An apparatus according to claim 8, wherein a color of said housing is substantially entirely black, and the color of said marks and at least the top surface of the contact member is yellow.

12. An apparatus according to claim 1, wherein said ink container contains an ink absorbing material.

13. An ink jet recording head, comprising:

a housing;

an ink container in said housing to contain ink;

an ink outlet for ejecting ink from said ink container;

energy generating means for generating energy for ejection of the ink through said ejection outlet;

a cavity having an opening, said cavity formed in said housing to permit engagement of said ink jet recording head with an electric contact member of an external energy source;

a set of electric contacts provided within said cavity on a wall defining aid cavity, the wall not facing the opening on said cavity, the electric contacts being electrically coupled with said energy generating means; and a window extending from said cavity for permitting observation of electric contact between said set of electric contacts and the electric contact member.

14. An ink jet recording head according to claim 13, wherein said energy generating means includes electrothermal transducer means for generating thermal energy.

15. An ink recording head according to claim 13, wherein said window is in a form of a slit having a length larger than a range in which said set of electric contacts are arranged.

16. An ink jet recording head according o claim 15, wherein said window extends to the vicinity of an ink ejecting portion of said ink jet recording head having said energy generating means.

17. An ink jet recording head according to claim 14, wherein said window and said cavity are aligned with each other.

18. An ink jet recording head according to claim 13, wherein a plurality of windows are provided in different walls defining said cavity.

19. An ink jet recording head according to claim 13, wherein said window is covered with a screen.

20. An ink jet recording head according to claim 13, wherein window is in a form of a slit, and marks are provided adjacent longitudinally opposite ends of said window.

21. An ink jet recording head according to claim 20, wherein each of said marks is triangular.

22. An ink jet recording head according to claim 20, wherein a color of said marks is relatively light.

23. An ink jet recording head according to claim 20, wherein a color of said housing is substantially entirely black, and a color of aid marks and the electric contact member is yellow.

24. An ink jet recording head according to claim 13, wherein said ink container contains an ink absorbing material.

* * * * *

UNITED STATES PATENT AND TRADEMARK OFFICE

CERTIFICATE OF CORRECTION

PATENT NO. : 5,162,818

DATED : November 10, 1992

INVENTOR(S) : Seiichiro KARITA, et al.

It is certified that error appears in the above-identified patent and that said Letters Patent is hereby corrected as shown below:

On the title page:

AT [56] REFERENCES CITED - U.S. PATENT DOCUMENTS:

Before "4,329,698" insert the following U.S. Patent Documents:

--3,836,913 9/1974 Burnett et al. .....346/75
4,234,884 11/1980 Vedder.....346/75
4,313,124 1/1982 Hara.....346/140 R--;

After "4,329,639 5/1982 Smith .....346/140 R" insert

--4,345,262 8/1982 Shirato et al.....346/140 R
4,459,600 7/1984 Sato et al.....346/140 R
4,463,359 7/1984 Ayata et al.....346/1.1
4,558,333 12/1985 Sugitani et al.....346/140 R--;

After "4,671,597 6/1987 Grill.....362/253" insert

--4,723,129 2/1988 Endo et al. .....346/1.1--;

UNITED STATES PATENT AND TRADEMARK OFFICE

CERTIFICATE OF CORRECTION

DATED : November 10, 1992

INVENTOR(S) : Seiichiro KARITA, et al.

It is certified that error appears in the above-identified patent and that said Letters Patent is hereby corrected as shown below:

After "4,734,717 3/1988 Rayfield.....346/140 R" insert

--4,740,796 4/1988 Endo et al.....346/1.1--;

After "4,963,897 10/1990 Kattner.....346/140 R" insert

--

FOREIGN PATENT DOCUMENTS

| | | |
|---|---|---|
| 54-056847 | 5/1979 | Japan |
| 59-123670 | 7/1984 | Japan |
| 59-138461 | 8/1984 | Japan |
| 60-071260 | 4/1985 | Japan |
| WO 8807935 | 10/1988 | International PCT |
| 3732396 | 4/1989 | Fed. Rep. of Germany |
| WO 8902827 | 4/1989 | International PCT |
| WO 8902828 | 4/1989 | International PCT |

--

COLUMN 1:

Line 26, "contact 6A." should read --contacts 6A.--;

Line 40, "contact 6" should read --contacts 6--;

Line 49, "long term" should read --long-term--;

Line 54, "an" should read --a--.

UNITED STATES PATENT AND TRADEMARK OFFICE

CERTIFICATE OF CORRECTION

DATED : November 10, 1992

INVENTOR(S) : Seiichiro KARITA, et al.

It is certified that error appears in the above-identified patent and that said Letters Patent is hereby corrected as shown below:

COLUMN 2:

Line 19, "embodiment" should read --embodiments--;

Line 43, "carriage AC." should read --carriage HC.--.

COLUMN 3:

Line 49, "abovedescribed" should read --above-described--.

COLUMN 4:

Line 40, "contacted to" should read --contacting--;

Line 44, "ribs 2300, however," should read --ribs 2300. However,--;

Line 57, "1400" should read --1401--, and "water repellent" should read --water-repellent--;

Line 59, "port 1400" should read --port 1401--.

COLUMN 6:

Line 15, "supply type 2200" should read --supply pipe 2200--;

Line 37, "take" should read --takes--;

UNITED STATES PATENT AND TRADEMARK OFFICE

CERTIFICATE OF CORRECTION

PATENT NO. : 5,162,818

DATED : November 10, 1992

INVENTOR(S) : Seiichiro KARITA, et al.

It is certified that error appears in the above-identified patent and that said Letters Patent is hereby corrected as shown below:

Line 53, "increases" should read --increases.--;

Line 63, "whole 320" should read --hole 320--.

COLUMN 9:

Line 4, "ink the" should read --ink from the--;

Line 48, "vent" should be deleted;

Line 49, "air port" should read --vent air port--;

Line 53, "contact 6a" should read --contacts 6a--.

COLUMN 10:

Line 15, "slit like" should read --slit-like--.

COLUMN 11:

Line 3, "slit like" should read --slit-like--;

Line 10, "operator's" should read --an operator's--;

Line 21, "image" should read --recording image--;

Line 25, "system;" should read --system--;

Line 26, "system" should read --system;--;

Line 33, "provide" should read --provided--;

Line 53, --abovementioned" should read --above-mentioned--.

UNITED STATES PATENT AND TRADEMARK OFFICE

CERTIFICATE OF CORRECTION

PATENT NO. : 5,162,818 Page 5 of 5

DATED : November 10, 1992

INVENTOR(S) : Seiichiro KARITA, et al.

It is certified that error appears in the above-identified patent and that said Letters Patent is hereby corrected as shown below:

COLUMN 12:

Line 19, "element" should read --element,--.

COLUMN 14:

Line 18, "aid" should read --said--;

Line 33, "o" should read --to--;

Line 37, "claim 14," should read --claim 13,--;

Line 46, "window" should read --said window--;

Line 55, "aid" should read --said--.

Signed and Sealed this

Twenty-second Day of February, 1994

Attest:

Bruce Lehman

BRUCE LEHMAN

Attesting Officer

Commissioner of Patents and Trademarks